US008754344B2

(12) United States Patent
Chiba

(10) Patent No.: US 8,754,344 B2
(45) Date of Patent: Jun. 17, 2014

(54) SEESAW SWITCH

(71) Applicant: Yazaki Corporation, Tokyo (JP)

(72) Inventor: Shingo Chiba, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/904,462

(22) Filed: May 29, 2013

(65) Prior Publication Data

US 2013/0256110 A1 Oct. 3, 2013

Related U.S. Application Data

(63) Continuation of application No. PCT/JP2011/080601, filed on Dec. 28, 2011.

(30) Foreign Application Priority Data

Dec. 28, 2010 (JP) ..... 2010-293089

(51) Int. Cl.
*H01H 3/20* (2006.01)

(52) U.S. Cl.
USPC ..... 200/556

(58) Field of Classification Search
USPC ..... 200/511, 339, 61.54–61.57, 553
See application file for complete search history.

(56) References Cited

U.S. PATENT DOCUMENTS

| | | | | |
|---|---|---|---|---|
| 5,149,924 A | | 9/1992 | Priesemuth | |
| 5,265,716 A | * | 11/1993 | Sawada et al. | 200/5 R |
| 5,647,478 A | * | 7/1997 | Hirai | 200/303 |
| 5,669,487 A | * | 9/1997 | Sakata | 200/339 |
| 5,735,392 A | | 4/1998 | Shirasaka | |
| 5,756,949 A | * | 5/1998 | Sato | 200/61.54 |
| 6,025,565 A | * | 2/2000 | Miyase et al. | 200/61.28 |
| 6,903,293 B2 | * | 6/2005 | Sasaki | 200/339 |
| 2002/0041496 A1 | | 4/2002 | Hatagishi et al. | |
| 2003/0147249 A1 | | 8/2003 | Hatagishi et al. | |
| 2005/0258023 A1 | | 11/2005 | Nagai et al. | |

FOREIGN PATENT DOCUMENTS

| | | |
|---|---|---|
| DE | 197 13 978 A1 | 10/1997 |
| JP | 2002-79879 A | 3/2002 |
| JP | 2003-234036 A | 8/2003 |
| JP | 2005-329884 A | 12/2005 |
| WO | 2012/002581 A1 | 1/2012 |

OTHER PUBLICATIONS

International Search Report and Written Opinion of the International Search Report for PCT/JP2011/080601 dated May 16, 2012.

* cited by examiner

*Primary Examiner* — Edwin A. Leon
(74) *Attorney, Agent, or Firm* — Kenealy Vaidya LLP

(57) ABSTRACT

A seesaw switch includes a seesaw switch knob, two contacts which extend from the seesaw switch knob, and busbars which contact individually the two contacts. A surface of each of the busbars has a wave shape including end root portions, a middle root portion disposed between the end root portions. Each of the two contacts moves from one of the end root portions to the other of the end root portions by way of the middle root portion to stop in the other of the end root portions while contacting corresponding one of the busbars when one of end portions of the seesaw switch knob is depressed.

4 Claims, 12 Drawing Sheets

SEESAW SWITCH

CROSS REFERENCE TO RELATED APPLICATIONS

This application is a continuation of PCT application No. PCT/JP2011/080601, which was filed on Dec. 28, 2011 based on Japanese Patent Application (No. 2010-293089) filed on Dec. 28, 2010, the contents of which are incorporated herein by reference.

BACKGROUND OF THE INVENTION

1. Field of the Invention

The present invention is related to a seesaw switch and more particularly to a busbar contact of a seesaw switch which is embedded in a lens of an interior illumination lamp of a vehicle.

2. Description of the Related Art

In general, an interior illumination lamp is provided in a ceiling of a vehicle. As an interior illumination lamp of this type, there is known an interior illumination lamp which includes: a functional portion which is fixedly mounted in the ceiling of the vehicle in a state that a part thereof is exposed from an opening portion of a ceiling panel which is an interior material; and a design portion which is a cover lens fitted in the opening portion of the ceiling panel from a passenger compartment side so as to be assembled to the functional portion. The functional portion has a switch, and the design portion has a slidable switch knob. When the design portion is assembled to the functional portion, a slider of the switch is brought into engagement with an engagement portion made up of a recess portion formed in the switch knob, whereby the switch can be operated by sliding the switch knob (refer to PTL 1).

However, when the design portion is assembled to the functional portion, it is necessary that the slider of the switch is accurately positioned with the engagement portion of the switch knob, this making the assembling work complex.

PTL 2 discloses a switch as a means for solving the problem.

The switch disclosed by PTL 2 is a seesaw switch which is intended to realize an improvement in the assembling work. A vehicle interior illumination lamp described in PTL 2 includes: a light source; a functional portion having a switch which establishes or interrupts a supply of electric power to the light source; and a design portion having a cover lens which covers the functional portion and a switch knob which controls a switch lever. In addition, the switch knob is mounted in the design portion so as to oscillate. An oscillation axis of the switch lever and an oscillation axis of the switch knob coincide with each other in a state that the functional portion and the design portion are assembled together.

According to the seesaw switch of PTL 2, the oscillation axis of the switch lever and the oscillation axis of the switch knob coincide with each other in a state that the functional portion and the design portion are assembled together, and therefore, the assembling property of the seesaw switch is improved.

However, the seesaw switch of PTL 2 holds problems that a number of components is increased to increase the production costs and a number of assembling steps is increased.

CITATION LIST

Patent Literature

[PTL 1] JP-A-2002-079879
[PTL 2] JP-A-2005-329884

SUMMARY OF THE INVENTION

It is therefore one advantageous aspect of the present invention to provide a seesaw switch which includes a decreased number of components so as to decrease the number of assembling steps to thereby improve the assembling property of the seesaw switch and which ensures a proper switch operation and allows the operator to feel a good switch operation feeling, and a contact thereof.

According to one advantage of the invention, there is provided a seesaw switch comprising:

a seesaw switch knob;

two contacts which extend from the seesaw switch knob; and busbars which contact individually the two contacts, wherein a surface of each of the busbars has a wave shape including end root portions, a middle root portion disposed between the end root portions, and wherein each of the two contacts moves from one of the end root portions to the other of the end root portions by way of the middle root portion to stop in the other of the end root portions while contacting corresponding one of the busbars when one of end portions of the seesaw switch knob is depressed.

Sloping angles of sloping surfaces of the end root portions may be smaller than a sloping angle of a sloping surface of the middle root portion.

The seesaw switch may be configured such that: the busbars include a first busbar and second busbar which contact individually the two contacts; the sloping surfaces of the end root portions of the first busbar are sloped at a first sloping angle from a root up to a halfway point and at a second sloping angle from the halfway point up to a peak of the end root portions; the sloping surfaces of the end root portions of the second busbar are sloped at a third sloping angle; and the third sloping angle is larger than the second sloping angle and is smaller than the first sloping angle.

The seesaw switch may be configured such that: at least one of a projection and a recess portion is formed on a sloping surface of at least one of the end root portions; at least one of a depression and a projecting portion is provided on each of the contacts; and the depression is configured to be brought into engagement with the projection and the projecting portion is configured to be brought into engagement with the recess portion, in a state where each of the contact stays still in one of the end root portions.

Thus, according to the first aspect of the invention, the switch can be made up of the contact and the wave-shaped portions of the busbars which are made up of the peaks and the roots, and therefore, the expensive balls and springs used in the conventional seesaw switches can be eliminated, this helping to reduce the production costs.

In addition, a proper switch operation feeling can be ensured by the spring property of the contact and the wave-shaped configuration of the busbars which comprises peaks and roots.

According to the second aspect of the invention, the sloping surfaces of the root portions at both the ends are more moderate than the sloping surfaces of the central root portion of the busbars, the switch operating load can be fluctuated, whereby the operating conditions of the switch can be altered.

According to the third aspect of the invention, the contact can be prevented from being forced out with the small load, whereby not only can the enlargement of the switch be prevented, but also the contact can be prevented from stopping in the midst of its movement.

According to the fourth aspect of the invention, the contact can be prevented further from being forced out with the small load.

BRIEF DESCRIPTION OF THE DRAWINGS

FIGS. 1A and 1B show perspective views of an interior illumination lamp assembly for a vehicle to which the invention is to be applied, of which FIG. 1A is a perspective view resulting when the vehicle interior illumination lamp assembly is seen from a front side, and FIG. 1B is a perspective view resulting when the vehicle interior illumination lamp assembly is seen from a back side thereof.

FIGS. 3A and 3B show perspective views showing states before and after a contact is press fitted in a switch knob, of which FIG. 3A is a perspective view showing the state before the press fitting of the contact and FIG. 3B is a perspective view showing the state after the press fitting of the contact.

FIGS. 9A and 9B show enlarged plan views of busbar portions into which Embodiment 2 is embodied, of which FIG. 9A is an enlarged view showing busbars and busbar portions with which a contacting portion of a switch knob is brought into contact, and FIG. 9B is a further enlarged view of the portion where the contact is brought into engagement with the busbar portions.

FIGS. 11A and 11B show sectional views of a busbar illustrating Embodiment 4, of which FIG. 11A is a vertical sectional view showing slopes with projections, and FIG. 11B is a vertical view showing slopes with recess portions.

DETAILED DESCRIPTION OF THE EXEMPLARY EMBODIMENTS

An interior illumination lamp assembly 10 for a vehicle includes a lens 20 and a housing 40. Locking holes 20K in the lens 20 are brought into engagement with locking projections 40K on the housing 40 so that the lens 20 and the housing 40 are integrated together to make up the vehicle interior illumination lamp assembly 10.

Figure 2:
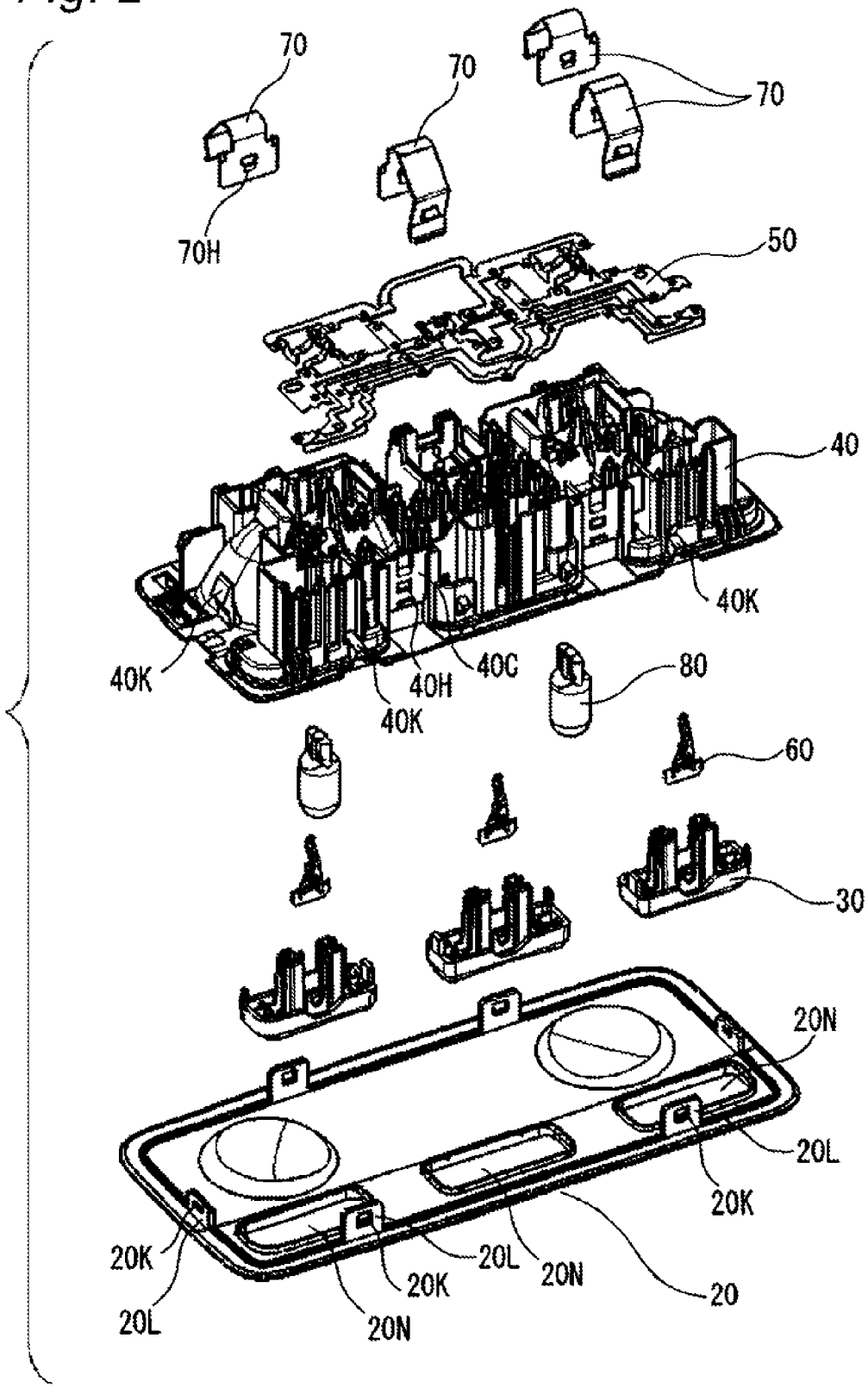
FIG. 2 is an exploded perspective view of the vehicle interior illumination lamp assembly which is in the state shown in FIG. 1B.

In FIG. 2, the vehicle interior illumination lamp assembly 10 includes, from top to bottom, metal clips 70, busbars 50, the housing 40, bulbs 80, contacts 60, switch knobs 30 and the lens 20.

Firstly, these individual constituent elements will be described as follows.

In FIG. 2, the lens 20 is a rectangular resin member which functions as a lens which transmits light from the bulbs 80. A plurality of locking members 20L each including a locking hole 20K are provided along a full circumference of a circumferential edge of the lens 20. In this embodiment, six locking members 20L are provided along the full circumference of the circumferential edge portion. In addition, insertion openings 20N (three in this embodiment) are opened in the lens 20 for insertion of the switch knobs 30. In FIG. 2, a designed surface is provided on a back side of the lens 20.

In FIG. 2, the housing 40 is a resin member which accommodates therein the switch knobs 30, the busbars 50, the contacts 60, the metal clips 70 and the bulbs 80, excluding the lens 20. A side of the housing 40 which faces the lens 20 is formed into a substantially rectangular shape. A plurality of locking projections 40K are provided along a full circumference of a circumferential edge of the rectangular side so as to project further outwards than a vertical surface thereof. In this embodiment, six locking projections 40K are provided along the full circumference of the circumferential edge.

In FIG. 2, the switch knobs 30 are seesaw switches, and the contacts 60 are press fitted thereinto. The switch knobs 30 each perform a seesaw motion. When one end portion of a depressible portion of the switch knob 30 is depressed, a distal end of the contact 60 is brought into contact with a mating terminal through seesaw motion. On the other hand, when the other end portion of the depressible portion is depressed, the distal end of the contact 60 moves away from the mating terminal and is then connected to another terminal.

Figure 3A:
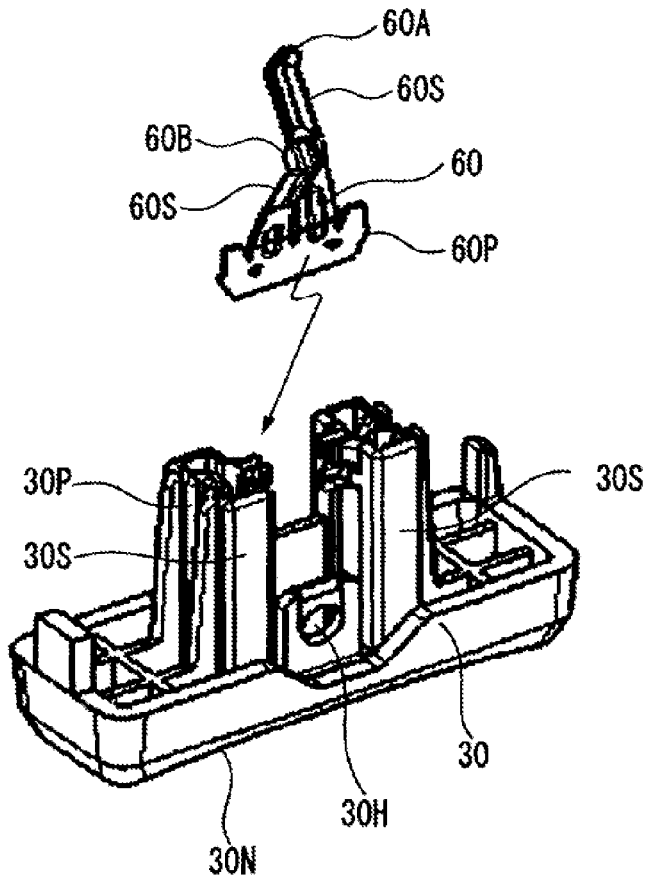

In FIG. 3A, the switch knob 30 includes a depressible portion 30N which has a flat narrow elongated lid shape, two pillar-shaped accommodating portions 30S which are erected vertically upwards from the depressible portion 30N as seen in the figure with an interval defined therebetween, a shaft hole 30H which is disposed in the center between the two accommodating portions 30S so as to be a center of the seesaw motion, and press fitting grooves 30P which are formed in facing surfaces of the two pillar-shaped accommodating portions 30S so that a press fitting portion 60P of the contact 60 is press fitted thereinto.

Figure 3B:
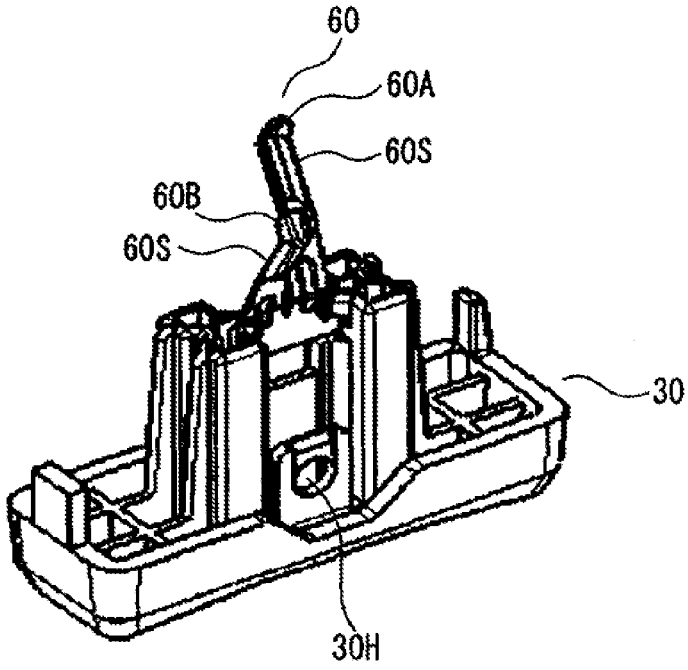

When the press fitting portion 60P of the contact 60 is press fitted into the press fitting grooves 30P in the two pillar-shaped accommodating portions 30S of the switch knob 30 from above in the way described above, the press fitting portion 60P of the contact 60 is accommodated in the switch knob 30 as FIG. 3B shows. Two leg portions 60S extend from the press fitting portion 60P of the contact 60 in opposite directions to each other, and the two leg portions 60S project from the switch knob 30 when the contact 60 is press fitted in the switch knob 30.

Then, when the switch knob 30 seesaws with respect to the shaft hole 30H in the switch knob 30, the two leg portions 60S projecting from the switch knob 30 swing about the shaft hole 30H.

Figure 4A:
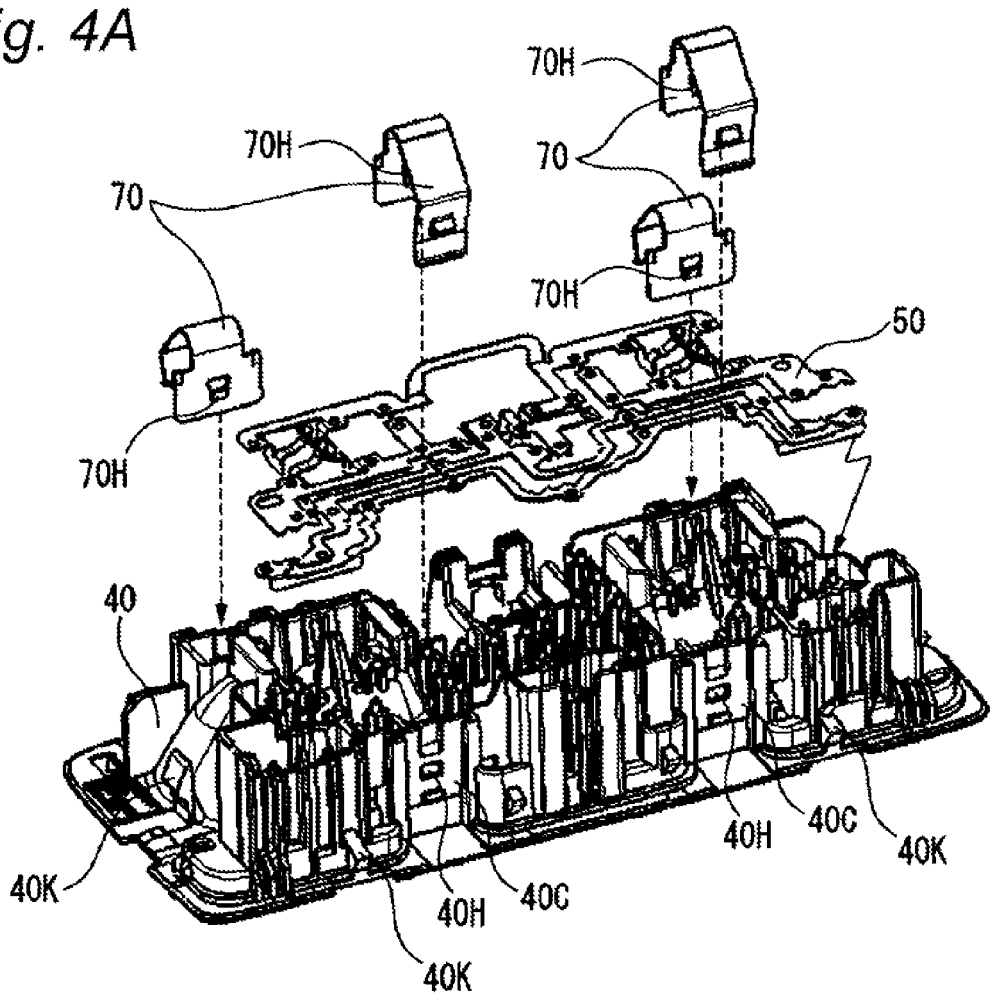
FIG. 4A is a perspective view showing a state before a busbar and metal clips are assembled to a housing.
Figure 4B:
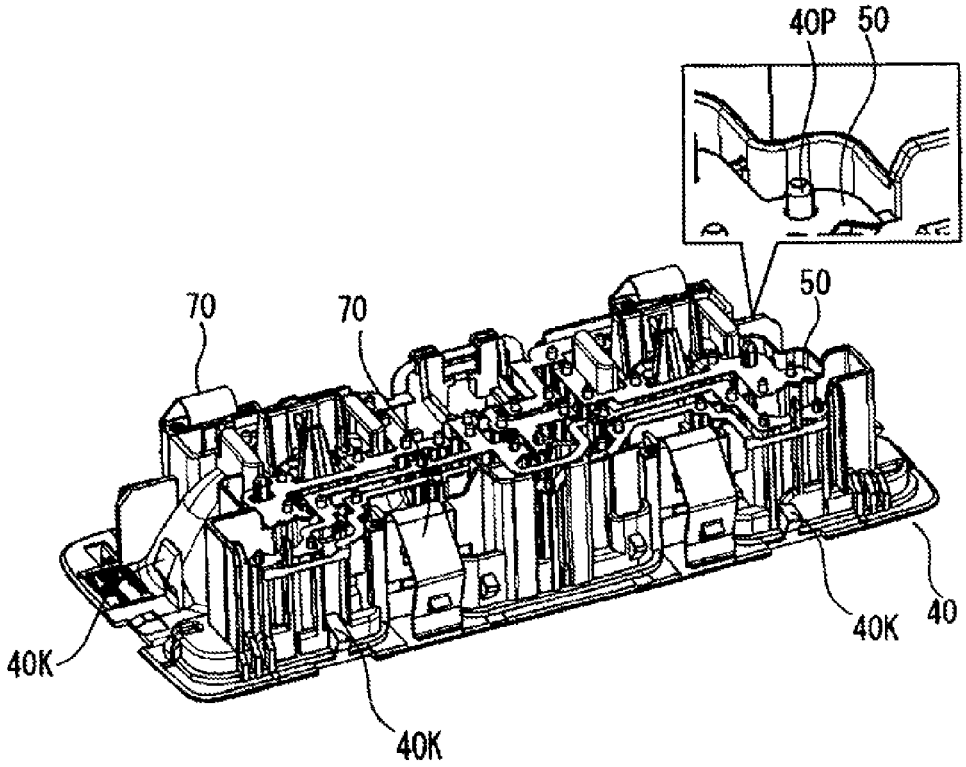
FIG. 4B is a perspective view showing a state after the busbar and the metal clips are assembled to the housing.

In FIG. 2, the busbars 50 are metallic elongated plates which connect portions of the switch knobs 30, the contacts 60 and the bulbs 80 which are mounted in the housing 40 which are to electrically be connected. The busbars 50 include a plurality of busbars. In FIGS. 4A and 4B, by being fitted into the housing 40 from above, the busbars 50 are configured as a lamp functional portion.

In FIG. 2, as is seen from the enlarged view in FIG. 3A, the contact 60 includes the press fitting portion 60P which is press fitted between the two accommodating portions 308 of the switch knob 30, the leg portions 60S, 60S which extend obliquely upwards in opposite directions to each other on the same side from two points which are situated equidistantly from the center of the press fitting portion 60P, and contacting portions (contacts) 60A, 60B which are provided at distal ends of the leg portions 60S, 60S, respectively. The press fitting portion 60P, the leg portions 60S, 60S and the contacting portions 60A, 60B are integrated together into the contact 60.

In FIG. 2, the metal clips 70 are each made by bending an elastic metal plate into a U-shape, and a locking piece 70H (also, refer to FIG. 4A) is formed on one of legs of the U-shape.

On the other hand, locking holes 40H (also, refer to FIG. 4A) are formed in clip locking portions 40C which are provided on an outer circumferential side of the housing 40. Thus, by bringing the locking pieces 70H on the metal clips 70 into engagement with the locking holes 40H in the clip locking portions 40C, the metal clips 70 are assembled to the housing 40 as FIG. 4B shows.

Figure 6:
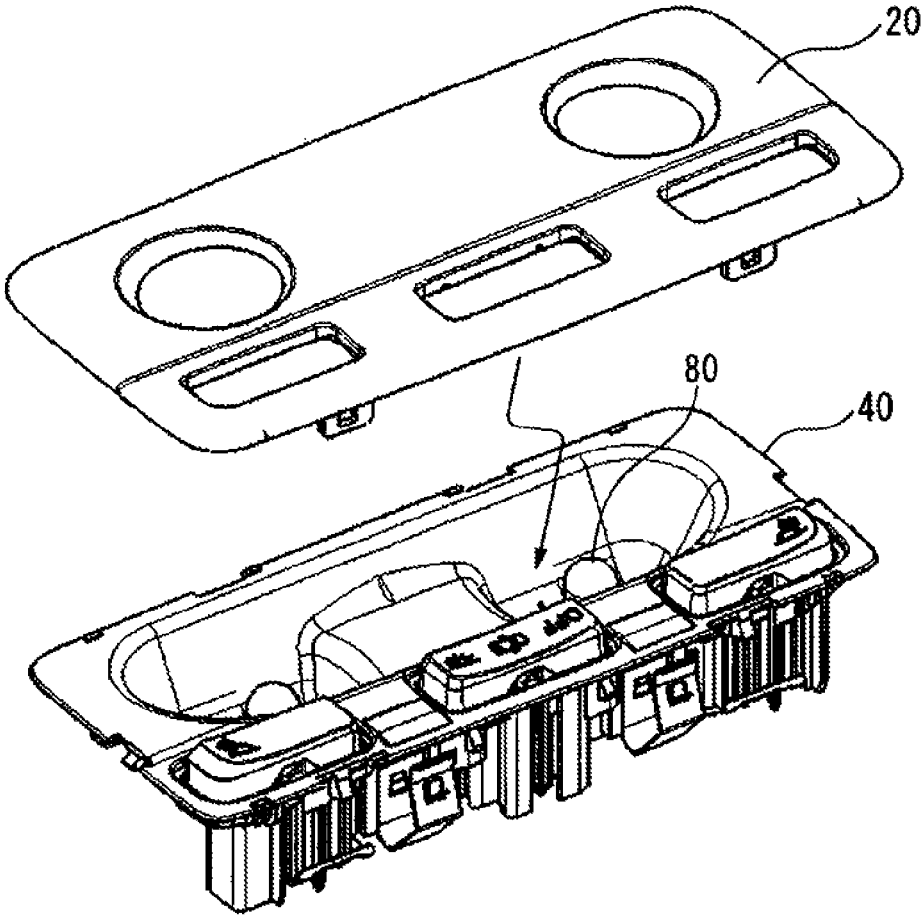
FIG. 6 is a perspective view showing a state before a lens is assembled to the housing after the bulbs have been assembled thereto.

In FIG. 2, the bulbs 80 are light sources and are turned on and off by signals from the vehicle. The bulbs 80 are accommodated in a bottom portion of a mortar-like shaped bulb accommodating portion 40L of the housing 40. Light emitted from the bulbs 80 which are accommodated in the bottom portion as FIG. 6 shows is directed towards the lens 20.

Next, there will be described an assembling procedure for the vehicle interior illumination lamp assembly which employs the constituent components that have been described above.

In a step 1, the contact 60 is press fitted in the switch knob 30.

In FIG. 3, firstly, the press fitting portion 60P of the contact 60 is press fitted into the press fitting grooves 30P in the two pillar-shaped accommodating portions 30S of the switch knob 30 from above in the figure, so that the contact 60 is mounted in the switch knob 30 as FIG. 3B shows.

In a step 2, the busbars 50 and the metal clips 70 are mounted in the housing 40.

The plurality of busbars 50 as FIG. 4A shows are mounted in predetermined positions in the housing 40. Pin insertion holes are opened in predetermined portions of the busbars 50, while pins 40P are erected at predetermined portions on the housing 40. Then, when the busbars 50 are mounted in the predetermined positions in the housing 40, the pins 40P on the housing 40 are inserted into the pin insertion holes in the busbars 50. A balloon portion in FIG. 4B depicts a state in which the pin 40P on the housing 40 is inserted in the pin insertion hole in the busbar 50. After the pins 40P on the housing 40 are inserted into the pin insertion holes in the busbars 50 in the way described above, the pins 40P are thermally fused, whereby the busbars 50 are fixed to the housing 40.

Further, the locking pieces 70H on the metal clips 70 are brought into engagement with the locking holes 40H in the clip locking portions 40C on the housing 40, whereby the metal clips 70 are assembled to the housing 40 as FIG. 4B shows.

In a step 3, the switch knobs 30 are assembled to the housing 40.

Figure 5A:
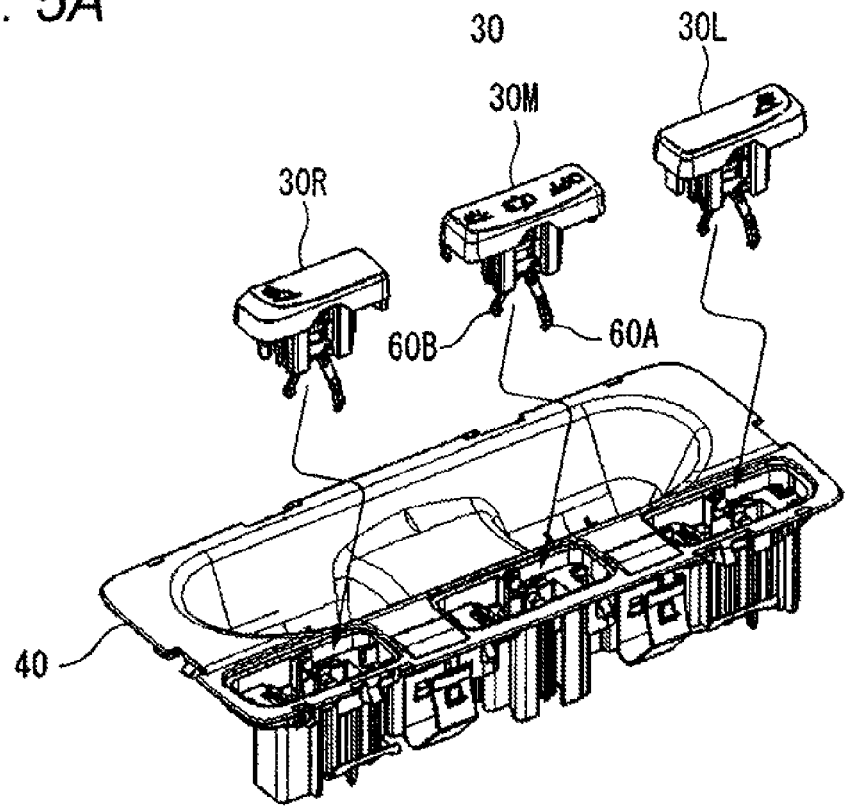
FIG. 5A is a perspective view showing a state before the switch knobs are assembled to the housing.

The switch knobs 30 (FIG. 3B) on which Step 1 has been completed are assembled in positions indicated by arrows in FIG. 5A in the housing 40 (FIG. 4B) on which Step 2 has been completed.

In a step 4, the bulbs 80 are assembled to the housing 40.

Figure 5B:
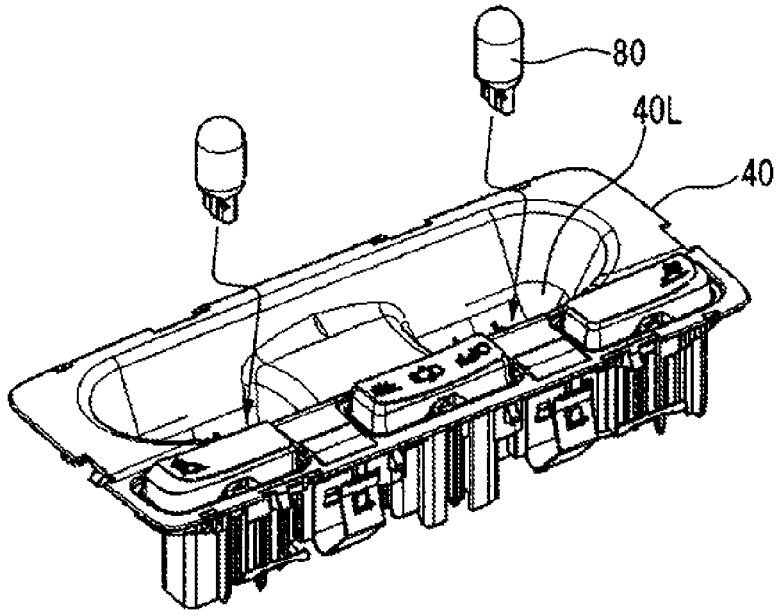
FIG. 5B is a perspective view before bulbs are assembled to the housing after the switch knobs have been assembled thereto.

The assemblies of the contacts 60 and the bulbs 80 are assembled in positions in the housing 40 which are indicated by arrows in FIG. 5B.

In a step 5, lens 20 is assembled to the housing 40.

Finally, the lens 20 is assembled to the housing 40 on which Step 4 has been completed. In order to assemble the lens 20 to the housing 40, the locking projections 40K on the housing 40 only have to be brought into engagement with the locking holes 20K in locking members 20L on the housing.

Figure 1A:
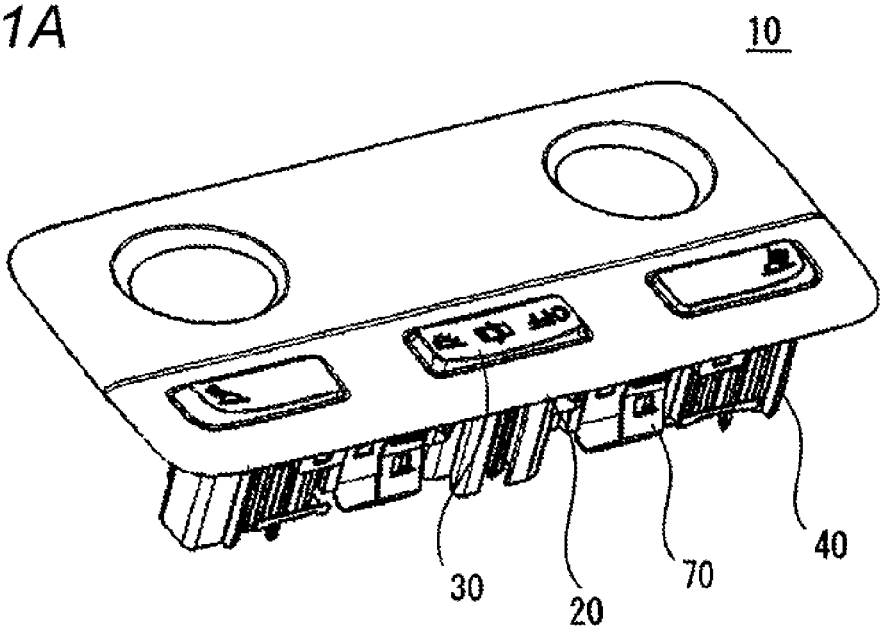
Figure 1B:
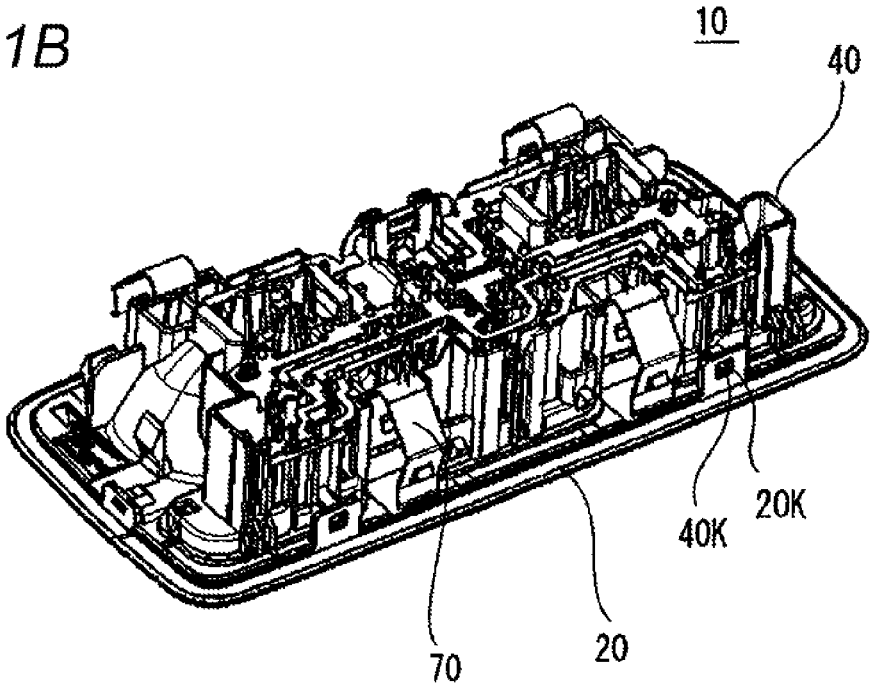

When all the components are mounted in the housing 40 in the way described above, the vehicle interior illumination lamp assembly 10 shown in FIG. 1 is completed.

Figure 7:
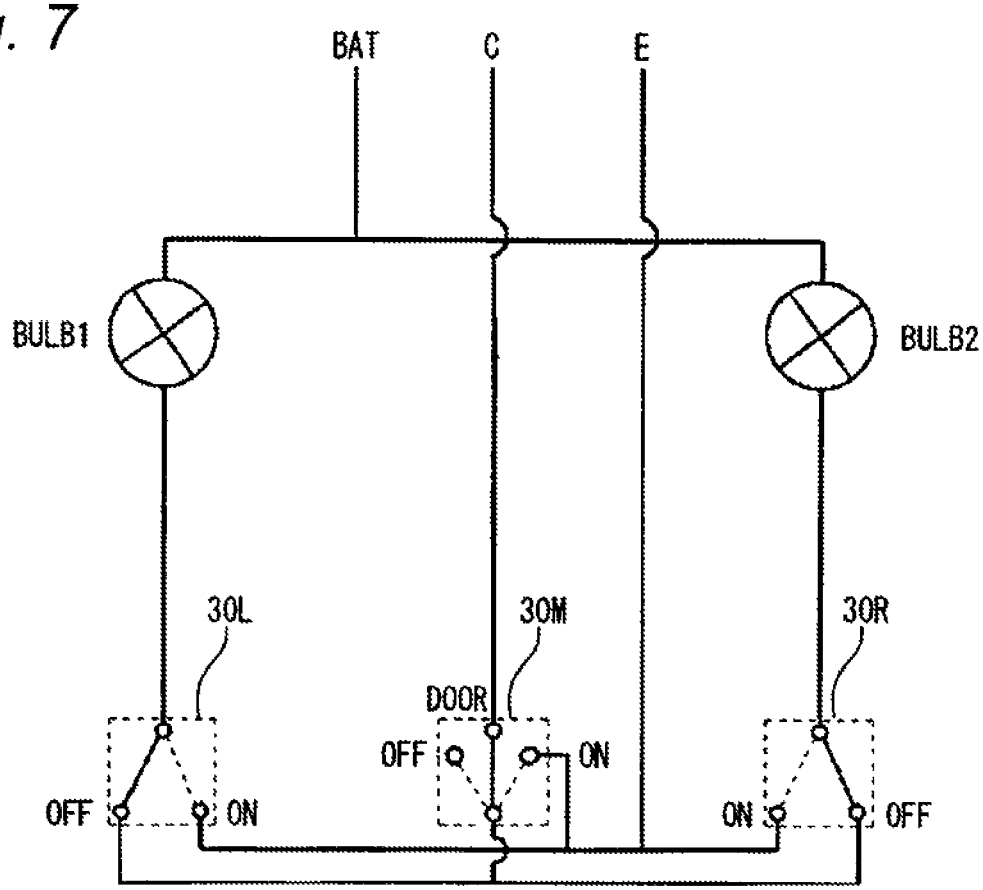
FIG. 7 shows a circuit diagram of the vehicle interior illumination lamp assembly shown in FIG. 1.

In FIG. 7, since there are provided three switch knobs 30, the switch knobs are referred to, from the right, as 30R (right), 30M (center or middle) and 30L (left). A vehicle interior illumination lamp assembly fabrication procedure using the components described above will be described. In these components or the switch knobs 30, a two-contact system is adopted for the switch knob 30R and the switch knob 30L, while a three-contact system is adopted for the switch knob 30M.

1) Operation of Switch Knob 30L:

1-1) The switch knob 30M is a switch which turns off bulbs when doors of the vehicle are closed with a contact of the switch knob 30M situated in a DOOR position and turns on the bulbs when any of the doors is opened. However, in order to turn on the bulb B1 whether the doors are opened or closed with the contact of the switch knob 30M situated in the DOOR position, a contact of the switch knob 30L is situated in an ON position.

Then, the circuit is closed in the order of the battery, the bulb B1, the ON position, and the ground line, whereby the bulb B1 is turned on.

1-2) In addition, in order to turn off the bulb B1 which is turned on, the contact of the switch knob 30L is situated in an OFF position. Then, the circuit extending via the battery, the bulb B1, the OFF position, the ground line is not formed, whereby the bulb B1 is turned off.

2) Operation of Switch Knob 30R:

2-1) In order to turn on the bulb 2 whether the doors are opened or closed with the switch knob 30M situated in the DOOR position, a contact of the switch knob 30R is situated in an ON position.

Then, the circuit is closed in the order of the battery, the bulb B2, the ON position, and the ground line, whereby the bulb B2 is turned on.

2-2) In addition, in order to turn off the bulb B2 which is turned on, the contact of the switch knob 30R is situated in an OFF position. Then, the circuit extending via the battery, the bulb B1, the OFF position, the ground line is not formed, whereby the bulb B2 is turned off, 3) Operation of Switch Knob 30M:

3-1) A DOOR position of the switch knob 30M is connected to a courtesy line C. and this courtesy line C is connected to door-open/closed switches which are provided at portions of a vehicle body which face the doors. When the doors are closed, the door-open/closed switches are off, whereas when the door or the doors are opened, the corresponding door-open/closed switch or switches are on. Consequently, even with the switch knob 30L for the bulb B1 situated in the OFF position and with the switch knob 30R for the bulb B2 situated in the OFF position, when the switch knob 30M is situated in the DOOR position, since the DOOR position is connected to the courtesy line C, when the doors are closed, the door-open/closed switches are off, whereby the bulbs B1, B2 are kept turned off. When the door or doors are opened, the corresponding door-open/closed switch or switches are on, whereby the bulbs B1, B2 are turned on.

3-2) When the switch knob 30M is situated in an ON position, the bulbs which are turned off with the contacts situated in the OFF positions are turned on whether the doors are opened or closed.

3-3) When the switch knob 30M is situated in an OFF position, the bulbs with the contacts situated in the OFF positions are turned off whether the doors are opened or closed.

Figure 8A:
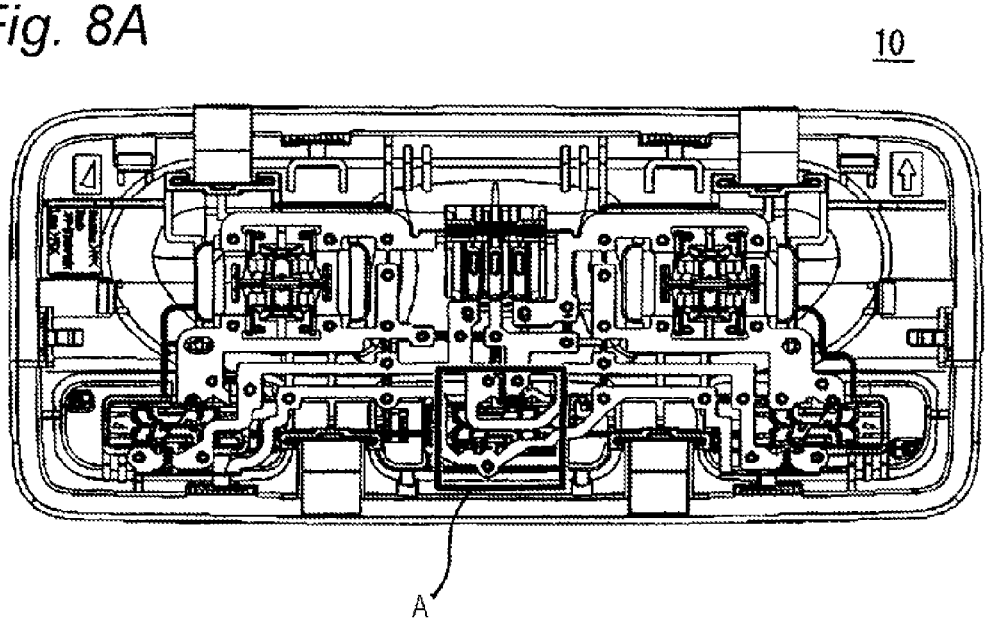
FIG. 8A is a plan view of the vehicle interior illumination lamp assembly as seen from a housing side.
Figure 8B:
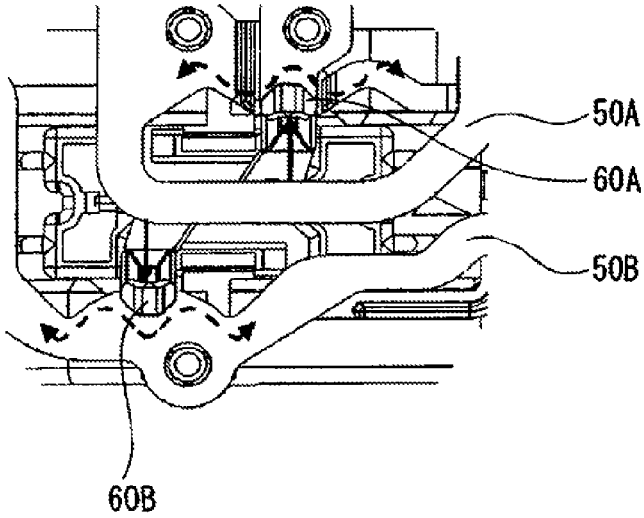
FIG. 8B is an enlarged view of a portion A in FIG. 8A where the contact (FIG. 3B) press fitted in the switch knob (FIG. 5A) comes into contact with the busbar.

FIG. 8A is a plan view of the vehicle interior illumination lamp assembly 10 as seen from a housing 40 side thereof, and FIG. 8B is an enlarged view of a portion A in FIG. 8A where the contact 60 which is press fitted in the switch knob 30M is brought into contact with the busbars 50. In FIGS. 8A and 8B, the contacting portion 60A and the contacting portion 60B which are situated at the distal ends of the two leg portions 60S, 60S which extend in the opposite directions from the contact 60 in the switch knob 30M are brought into contact with the busbar 50A and the busbar 50B, respectively. Since the two leg portions 60S, 60S are elastic, strong reaction force is applied to the contacting portion 60A and the contacting portion 60B which are situated at the distal ends of the two leg portions 60S, 60S in directions indicated by arrows in which the busbar 50A and the busbar 50B move away from each other.

In Embodiment 1 of the present invention, contact areas of busbars 50A and 50B with which contacting portions 60A and 60B of a contact 60 are brought into contact are formed not into a straight line but into the shape of a wave made up of peaks and roots. Then, when the contacting portion 60A stays still at a rightmost root in the busbar 50A, the contacting portion 60B also stays still in a rightmost root in the busbar 50B. Likewise, when the contacting portion 60A stays still in a leftmost root in the busbar 50A, the contacting portion 60B also stays still in a leftmost root in the busbar 50B. Likewise, when the contacting portion 60A stays still in a middle root portion in the busbar 50A, the contacting portion 60B also stays still in a middle root portion in the busbar 50B.

FIG. 8B shows a state in which the contacting portion 60A of the contact 60 in the switch knob 30M stays still in the middle root portion in the busbar 50A and the contacting portion 60B also stays still in the middle root portion in the busbar 50B.

When the contacting portion 60A slides down from a rightmost peak of the busbar 50A, the contacting portion 60B also slides down from a rightmost peak of the busbar 50B in the same direction as that the contacting portion 60A does. This holds true for the other peaks.

In this way, according to the invention, the switch can be made up of the contact 60 and the wave-shaped configurations of the busbars 50 which include the peaks and the roots. Therefore, the expensive balls and springs which are used in the conventional seesaw switch can be eliminated, thereby making it possible to decrease the production costs.

In addition, a good switching feeling can be ensured by the spring property of the contact 60 and the wave-shaped configurations of the busbars 50 which include the peaks and the roots.

Embodiment 2 of the present invention is characterized in that in busbars 50A, 50B with which contacting portions 60A and 60B of a contact 60 are brought into contact, a sloping angle of a middle root portion is made steep, whereas sloping angles of root portions at ends are made moderate.

Figure 9A:
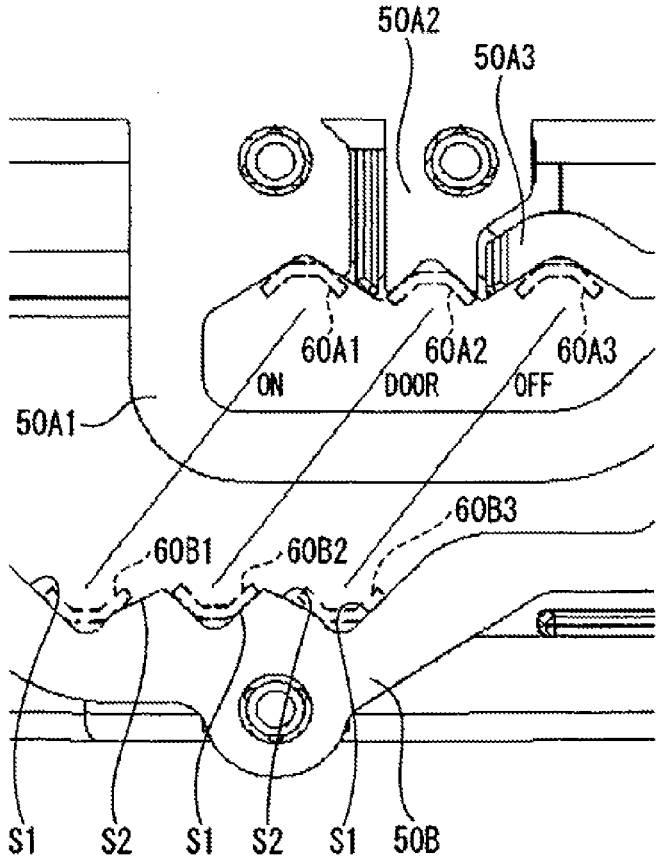
Figure 9B:
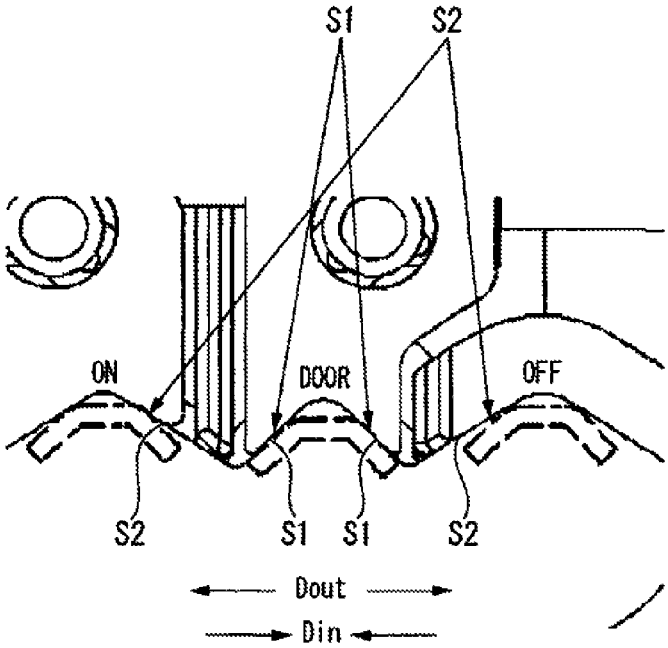

FIG. 9A is an enlarged view showing portions of busbars 50A1, 50A2, 50A3 and the busbar 50B with which a contacting portion 60A and a contacting portion 60B of a switch knob 30M are brought into contact, and FIG. 9B is an enlarged view showing in a more enlarged fashion portions of the busbars 50A1, 50A2, 50A3 with which the contacting portion 60A is brought into contact.

In FIGS. 9A and 9B, the contacting portions 60A and 60B when the contacting portions 60A and 60B stay still in leftmost (ON) root portions of the busbars 50A1 50B are referred to as 60A1 and 60B1, respectively. The contacting portions 60A and 60B when the contacting portions 60A and 60B stay still in middle (DOOR) root portions of the busbars 50A2, 50B are referred to as 60A2 and 60B2, respectively. The contacting portions 60A and 60B when the contacting portions 60A and 60B stay still in rightmost (OFF) root portions of the busbars 50A3, 50B are referred to as 60A3 and 60B3. Then, slopes of the root portions of the busbars where the contacting portions 60A1 and 60B1, and the contacting portions 60A3 and 60B3 stay still are made into slopes S2 with a moderate sloping angle, and slopes of the root portions where the contacting portions 60A2 and 60B2 stay still are made into slopes S1 with a steep sloping angle.

By adopting this configuration, when the contacting portions 60A2 and 60B2 move in directions Dout indicated by arrows in FIG. 9B, that is, when the contacting portions 60A2 and 60B2 which are in the middle root portions move to either the left root portions or the right root portions, the operating load is increased. On the contrary, when the contacting portions 60A1 and 60B1, and the contacting portions 60A3 and 60B3 move in directions Din indicated by arrows in FIG. 9B, that is, when the contacts in the left or right root portions move to the middle root portions, the operating load is decreased. Thus, the operating conditions of the contacting portions can be changed accordingly.

Embodiment 3 of the present invention relates to a device to be made for two pairs of busbars and contacts.

In general, steep slopes of a root portion where a contact stays still can provide an advantage that the contact is prevented from moving easily with a low switch operating load. However, the depth of the root portion has to be increased so as to make the slopes steep, leading to a drawback that the size of a switch itself is enlarged. Thus, the decrease in switch operating load and the decrease in size of the switch are incompatible with each other.

However, when there are two pairs of busbars and contacts, those incompatible desires can be satisfied by Embodiment 3.

Figure 10:
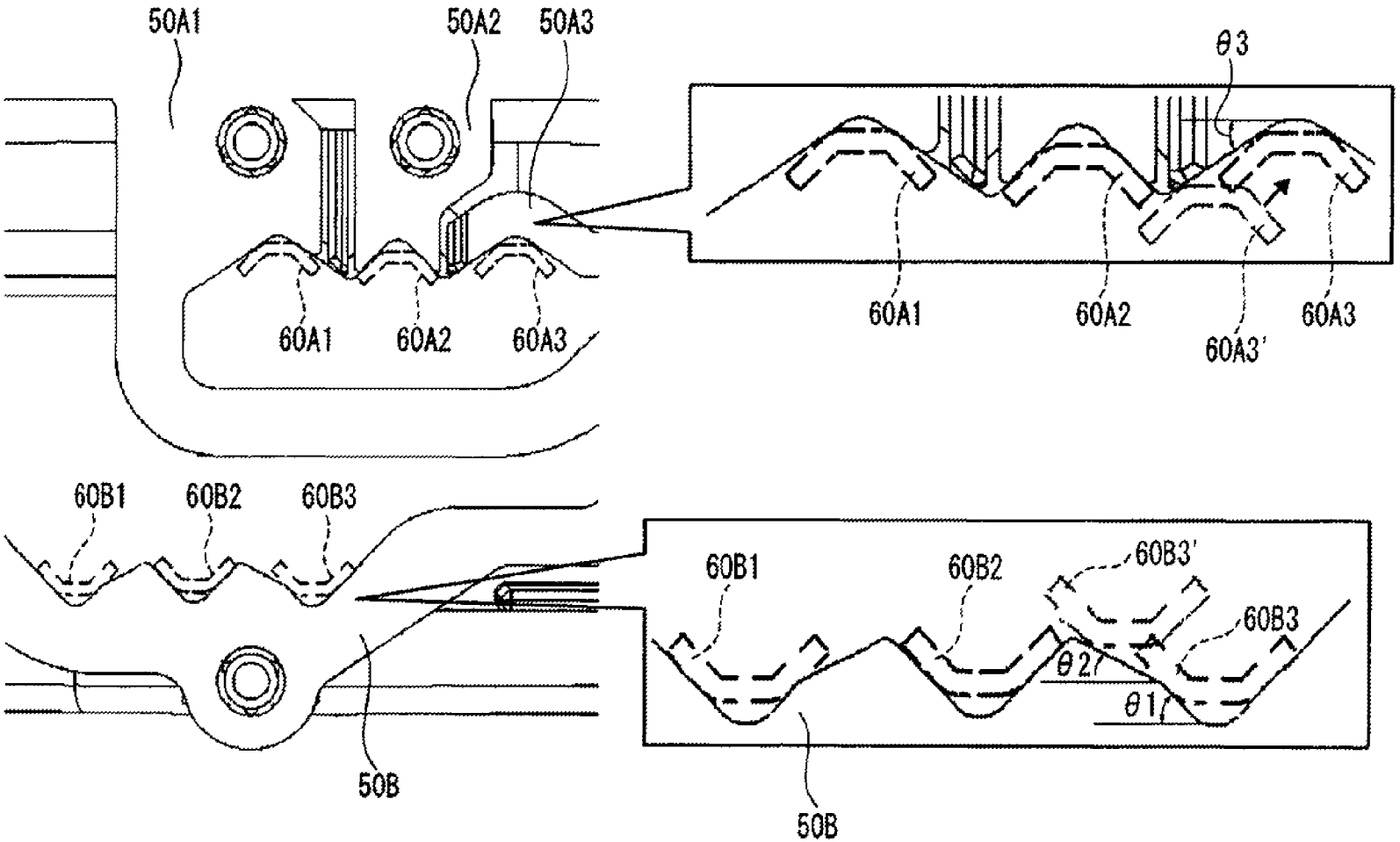
FIG. 10 is an enlarged plan view illustrating Embodiment 3 which depicts a slope of a root portion of an upper busbar and a slope of a root portion of a lower busbar in the figure.

FIG. 10 is a drawing illustrating Embodiment 3. In the figure, slopes of root portions in upper busbars 50A1, 50A2, 50A3 and slopes of root portions in a lower busbar 50B are set as follows.

Slopes of left and right root portions 50B1 and 50B3 in the lower busbar 50B are steep (at a sloping angle θ1) from root bottoms up to halfway points along the slopes and are then moderate (at a sloping angle θ2) from the halfway points up to peaks of the slopes (θ1>θ2). In addition, slopes of root portions of the upper busbars 50A1, 50A3 are constant (at a sloping angle θ3. The three sloping angles are in a relationship of θ1>θ3>θ2.

In the root portions of the upper busbars 50A1, 50A2, 50A3, the slopes (the sloping angle θ3) of the root portions 50A1, 50A3 of the left and right busbars are made steeper than the slopes (the sloping angle θ2) of the root portions 50B1 and 50B3 of the left and right busbars of the lower busbar 50B. Thus, in this configuration, even in the event that the lower contact 60B1 (or 60B3) is about to stop while it is moving along the moderate sloping surface, the upper contacting portion 60A1 which is integral with the contact 60B1 is moving along the steep sloping surface, and hence, the upper contacting portion 60A1 entrains the contact 60B1 which is about to stop, whereby the contact 60B1 is prevented from stopping in the middle of moving along the moderate sloping surface.

The slopes of the left and right root portions of the lower busbar 50B are steep (at the sloping angle θ1) up to the halfway points and are then moderate (at the sloping angle θ2) from the halfway points up to the peaks. Thus, the contact 60B1 (or 60B3) stays still at the bottom of the root portion whose slopes are steep, thereby making it possible to prevent the contact 60B1 from being easily forced out of the root portion. However, in the event that all the slopes of the root portions are made steep (at the sloping angle θ1) so as to prevent the contact from being forced thereout, the root bottoms have to lie deep in the root portions to ensure a long distance to the adjacent roots. However, this increases the size of the switch, and hence, this approach cannot be adopted. Consequently, the slopes have to be made moderate from the halfway point. However, with the moderate sloping surface, the problem of the contact stopping in the midst of its movement is caused on the contrary, and hence, this approach cannot also be adopted.

According to Embodiment 3, by adopting the relationship of θ1>θ2, the contact can be prevented from being forced out of the root portion and the enlargement of size of the switch can also be prevented. In addition, by adopting the relationship of θ3>θ2 proposed in Embodiment 3, the biggest drawback of the contact stopping in the midst of its movement which results from adopting the inclination angle θ2 can be prevented.

Figure 11A:
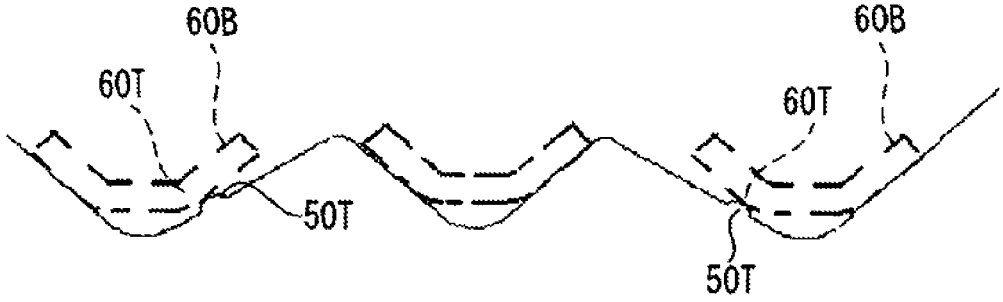
Figure 11B:
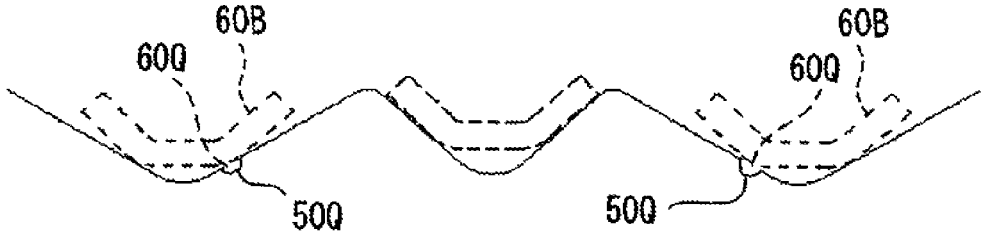

FIG. 11A is a sectional view of slopes with projections, and FIG. 11B is a sectional view of slopes with recess portions, according to Embodiment 4 of the present invention.

In FIG. 11A, projections 50T are formed on slopes of a busbar 50. On the other hand depressions 60T are formed in a contact 60. When the contact 60 comes to stay still in a root, the projections 50T are brought into engagement with the depressions 60T.

Consequently, since in a contacting portion 60B which stays still in the root, the projections 50T are in engagement with the depressions 60T, and therefore, the contacting portion 60B can be prevented from being forced out easily with a small load.

In FIG. 11B, recess portions 50Q are formed in slopes of the busbar 50. On the other hand, projecting portions 60Q are formed on the contacting portion 60B. When the contacting portion 60B comes to stay still in a root, the projecting portions 60Q are brought into engagement with the recess portions 50Q.

Consequently, since in the contacting portion 60B which stays still in the root, the projections 60Q are in engagement with the recess portions 50Q, and therefore, the contacting portion 60B can be prevented from being forced out easily with a small load.

A seesaw switch according to the present invention can decrease number of components so as to decrease a number of assembling steps to thereby improve the assembling property of the seesaw switch, and ensures a proper switch operation and allows the operator to feel a good switch operation feeling.

What is claimed is:

1. A seesaw switch comprising:

a seesaw switch knob;

two contacts which extend from the seesaw switch knob and are conductive to each other; and busbars which contact individually the two contacts, wherein a surface of each of the busbars has a wave shape including end root portions, a middle root portion disposed between the end root portions, and wherein each of the two contacts moves from one of the end root portions to the other of the end root portions by way of the middle root portion to stop in the other of the end root portions while contacting corresponding one of the busbars when one of end portions of the seesaw switch knob is depressed.

2. A seesaw switch comprising:

a seesaw switch knob;

two contacts which extend from the seesaw switch knob; and busbars which contact individually the two contacts, wherein a surface of each of the busbars has a wave shape including end root portions, a middle root portion disposed between the end root portions, wherein each of the two contacts moves from one of the end root portions to the other of the end root portions by way of the middle root portion to stop in the other of the end root portions while contacting corresponding one of the busbars when one of end portions of the seesaw switch knob is depressed, and wherein sloping angles of sloping surfaces of the end root portions are smaller than a sloping angle of a sloping surface of the middle root portion.

3. The seesaw switch as set forth in claim 2, wherein the busbars include a first busbar and second busbar which contact individually the two contacts, wherein the sloping surfaces of the end root portions of the first busbar are sloped at a first sloping angle from a root up to a halfway point and at a second sloping angle from the halfway point up to a peak, wherein the sloping surfaces of the end root portions of the second busbar are sloped at a third sloping angle, and wherein the third sloping angle is larger than the second sloping angle and is smaller than the first sloping angle.

4. The seesaw switch as set forth in claim 1, wherein at least one of a projection and a recess portion is formed on a sloping surface of at least one of the end root portions, at least one of a depression and a projecting portion is provided on each of the contacts, and the depression is configured to be brought into engagement with the projection and the projecting portion is configured to be brought into engagement with the recess portion, in a state where each of the contact stays still in one of the end root portions.

* * * * *